United States Patent [19]

Siegel

[11] 3,969,596

[45] July 13, 1976

[54] COMBINATION LOCK FOR THE IGNITION HOOD AND TRUNK OF AN AUTOMOTIVE VEHICLE

[76] Inventor: Frederick Siegel, 2228 Monroe, Hollywood, Fla. 33020

[22] Filed: Feb. 26, 1975

[21] Appl. No.: 553,175

[52] U.S. Cl. ..... 200/43; 307/10 AT; 70/313

[51] Int. Cl.[2] ..... H01H 27/10

[58] Field of Search ..... 200/43, 45; 307/10 AT; 340/64, 65; 317/134; 70/313

[56] References Cited

UNITED STATES PATENTS

| | | | |
|---|---|---|---|
| 3,251,204 | 5/1966 | Siegel | 307/10 AT |
| 3,602,657 | 8/1971 | Espinosa | 200/43 |

*Primary Examiner*—Herman J. Hohauser
*Attorney, Agent, or Firm*—Ernest H. Schmidt

[57] ABSTRACT

This invention pertains to a security lock of the combination type for the ignition, hood and trunk compartments of an automotive vehicle. The proper sequential operation of a plurality of pre-selected push buttons associated therewith conditions the electrical system of the device to permit the conventional ignition key of the vehicle to be actuated to start the car engine, or to selectively operate switches to open the hood or trunk lid by means of solenoid latches. Each push button is provided with an arm which actuates a control shaft to a limited degree and is lockingly engaged by a lock bar to condition the electrical system to permit operation of the ignition key, or the trunk or hood switches when the proper sequential manipulation of the push buttons has been accomplished. When a single push button is actuated out of sequence, the lock bar is released and the entire system returns to a neutral condition. Safety means are provided in the nature of a guard which is actuated to prevent accidental manipulation of the ignition, hood or trunk switches.

12 Claims, 8 Drawing Figures

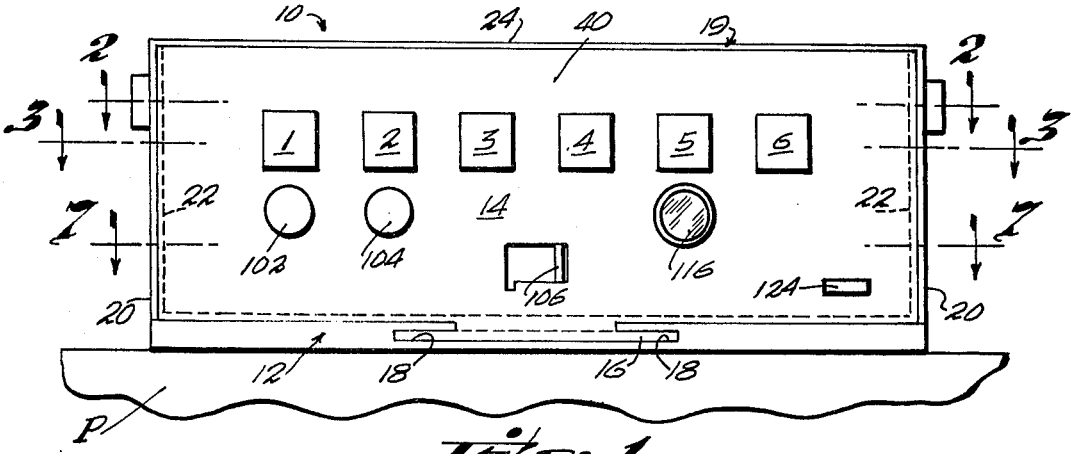
Fig. 1
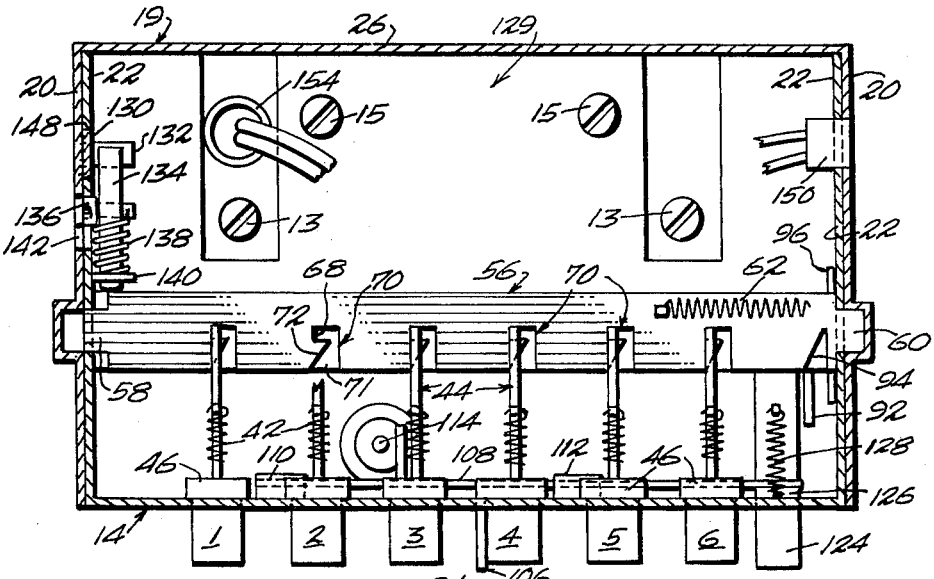
Fig. 2
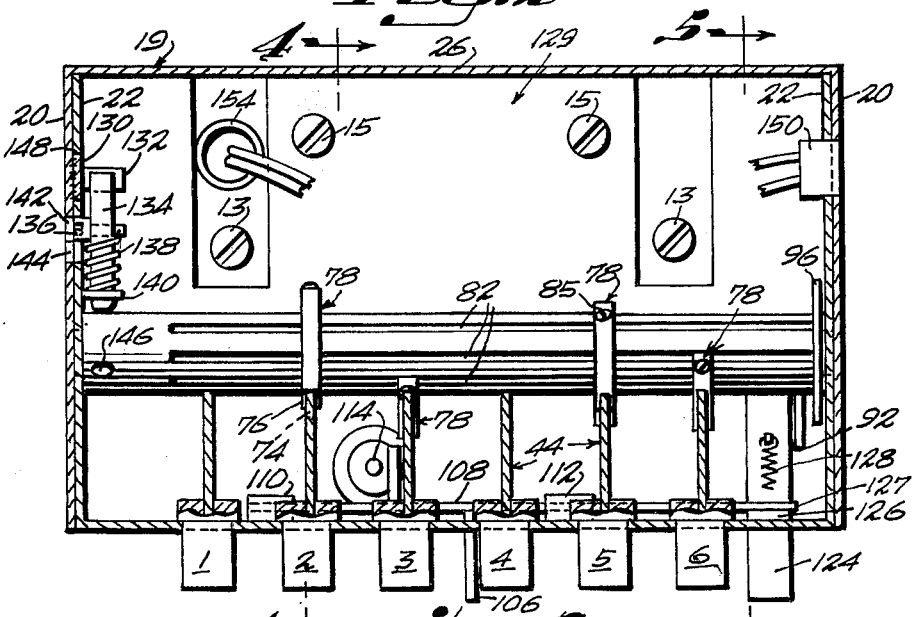
4 Fig. 3 5

COMBINATION LOCK FOR THE IGNITION HOOD AND TRUNK OF AN AUTOMOTIVE VEHICLE

OBJECTS AND ADVANTAGES OF THE PRESENT INVENTION

One of the principal objects of the present invention is to provide a security lock of the combination type, for an automotive vehicle, the operation of which actuates an electric switch means to selectively permit the operation of the ignition switch to start the engine of the vehicle or to open the hood or trunk lid thereof by means of solenoid actuated latches.

Another principal object of this invention is to provide a vehicle security lock of the character above described which includes a plurality of outwardly-extending push buttons, a number of which are rendered operable in a predetermined sequential order by means of lugs fixed relative to a control shaft, rotatably mounted within a housing.

A further object of the instant invention is to provide arm means, extending inwardly from each push button, to actuate the control shaft when said buttons are depressed in the proper sequence to rotate said control shaft a predetermined number of degrees to actuate a main electric switch means to condition an electric circuit for selective operation of the ignition switch or switches operably connected in electric circuits to the hood and trunk lid solenoid latches.

Yet another object of the present invention is to provide a lock bar associated with the push button arms and control shaft which automatically locks the push buttons in their depressed positions only when said push buttons are depressed in their proper sequential order, and which automatically releases the control shaft for return to its normal start position when one button is depressed out of order or an improper button is depressed.

A still further object of this invention is to provide a safety guard means which operates an electric switch to illuminate a pilot light to visually indicate that the ignition, hood and trunk switches are conditioned for operation and which secondarily conditions a push arm, the actuation of which deactivates the main electric switch to prevent accidental use of the ignition, hood or trunk switches.

Another object of this invention is to provide means to prevent removal of the cover housing of the device except after the proper combination has been made.

BRIEF DESCRIPTION OF THE DRAWINGS

FIG. 1 is a front elevational view of the combination lock device of the present invention, mounted atop the instrument panel of an automotive vehicle;

FIG. 2 is a longitudinal cross-sectional view taken along the line 2—2 of FIG. 1;

FIG. 3 is a longitudinal cross-sectional view taken along the line 3—3 of FIG. 1;

DETAILED DESCRIPTION OF THE DRAWINGS

Figure 4:
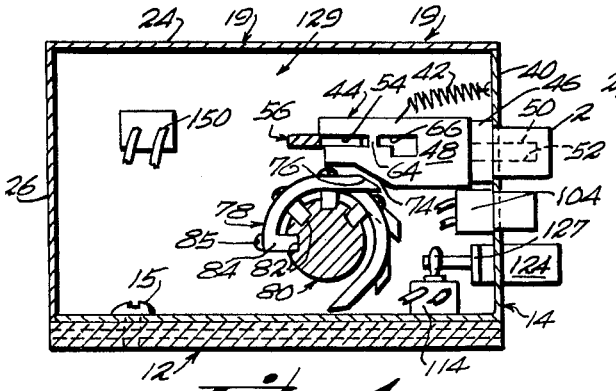
FIG. 4 is a vertical cross-sectional view taken along the line 4—4 of FIG. 3.

With reference to the drawings and with particular reference to FIG. 1, the combination lock device of the present invention is designated generally at 10 and includes a housing, comprised of a first portion comprising a base member 12 fixed as by screws 13, FIG. 2, atop the instrument panel P of an automotive vehicle, a second housing member 14 fixed to the base member 12 by screws 15 and providing an open top and back end, is slidably engaged with said base member by means of a central bottom tongue plate 16, engaged in oppositely extending groove means 18, 18 formed in said base member 12. A third housing member 19 includes opposed side walls 20, 20, overlying the respective side walls 22, 22 of the second member 14, and top and rear walls 24 and 26. The third housing member is removably engaged with the second housing member 14 by means operable by the combination mechanism of the device, hereinafter described.

As illustrated in the drawings, the device includes a plurality of combination-making push buttons, six as illustrated, numbered 1 through 6, slidably engaged through a front wall 40 of the second housing member 14. Each of the push buttons, such as button 2, is held in a normal outwardly-extending position by means of a tension spring 42 connected between an inwardly-extending arm 44, fixed relative to the inside end of the push button, and the inner side of the front wall 40. Each push button, as button 2, also includes a headed inner end 46 to limit the outward movement thereof.

With reference to FIG. 4, the arm 44 of each push button 1 through 6 is comprised of a main body portion 48 and a reduced width portion 50, slidably frictionally engaged in an appropriate hole 52 in a push button, such as button 2. The inner end portion of each arm 44 is bifurcated to form an inwardly opening slot 54 to slidably engage with a longitudinal lock bar 56. As best illustrated in FIG. 2, the lock bar 56 includes reduced width end portions 58 and 60 slidably engaged relative to the overlapping end walls 20, 20 and 22, 22 of the second and third housing members 14 and 19. The lock bar 56 is normally urged to the right by means of a tension spring 62 connected between the lock bar 56 and the right end wall 22.

With further reference to FIG. 4, each push button arm 44 includes a vertically-extending web 64 at the inner end of the slot 54. A cut-out 66 rearwardly of the slot 54 defines the web 64. When the proper sequence of operation of the push buttons 28 through 38 is being accomplished, each web 64 of a push button arm 44, as it is being moved inwardly, will engage in a notch 68 at the inner end of a slot 70 in the lock bar 56. Each slot 70 includes a throat opening 71 for entrance of the web 64 and an inwardly angulated wall 72 for engagement with the web 64 to move the lock bar 56 to the left against the forces of the compression spring 62 as the push button is being depressed. When a push button such as the button 2 is fully depressed, the lock bar 56 will be moved back to the right by means of the tension spring 62 to engage the web 64 of the arm 44 in a notch 68 at the inner end of slot 70 of the lock bar 56.

Each arm 44 includes a lower abutment portion 74 for engagement with a mating abutment surface 76 of a generally arcuate lug 78 fixed relative to a control shaft 80 longitudinally journaled between the side walls 22, 22 of the second housing member 14. The control shaft 80 is provided with four equally spaced-apart longitudinal grooves 82 to receive respective radially-extending leg 84 of an arcuate lug 78, fixed therein by a screw 85.

Figure 5:
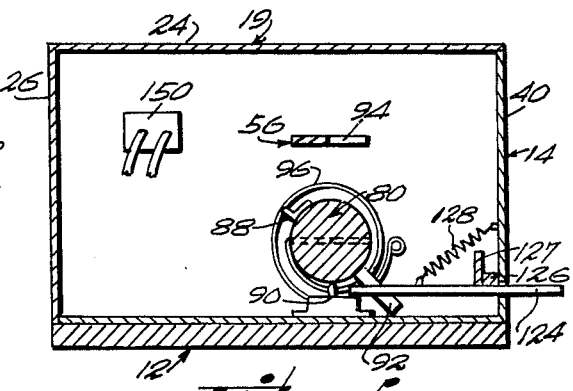
FIG. 5 is a vertical cross-sectional view taken along the line 5—5 of FIG. 3.

In the form of the invention illustrated in the drawings, a four digit combination is required to activate the electrical circuit to the ignition, hood and trunk. Therefore, four of the push buttons 1 through 6 include arms 44 to sequentially engage the four arcuate lugs 78 fixed relative to the four longitudinal grooves 82 as by screws 85. The arcuate lugs 78 are fixed in the respective grooves 82 in an order to define the combination or sequential order of operation of the push buttons 1 through 6. The lugs are disposed in an order whereby the proper sequential operation of the four push buttons will continue to rotate the control shaft 80 until a lug 88 fixed to said control shaft 80 trips a toggle switch 90 to an "on" position as seen in FIG. 5.

The abutment surfaces 76 of the arcuate lugs 78 are contacted by the mating abutment surfaces 74 of the arms 44 in a sequence determined by the selected positioning of said lugs 78 in the four longitudinal grooves 82. The combination may, therefore, be changed at will by repositioning the arcuate lugs 78 relative to the respective grooves 82.

When the four push buttons have been actuated in the proper order to make the combination to trip the toggle switch 90 to an "on" position, an arm 92 carried by the control shaft 80 simultaneously engages in a cam slot 94 in the longitudinal lock bar 56 to move same to the left to disengage the arm webs 64 from the notches 68 to return all of the push buttons to their neutral positions, resulting in the return of the control shaft 80 to its normal position by means of a helical torsion spring 96 surrounding one end of said control shaft 80 and secured at one end thereto and at the other end to a side wall 22.

If an improper push button 1 through 6 is depressed or one button is depressed out of its proper order, the lock bar 56 will be moved to the left by means of a vertical arm web 64 as previously described, however, there will be no arcuate lug 78 positioned for contact by an arm abutment surface 74. Consequently, any vertical web 64 previously engaged in a notch 68 of the lock bar 56 will be released by sidewise movement of said lock bar 56 and the control shaft 80 will return, under the influence of the helical torsion spring 96, to its normal position.

Figure 7:
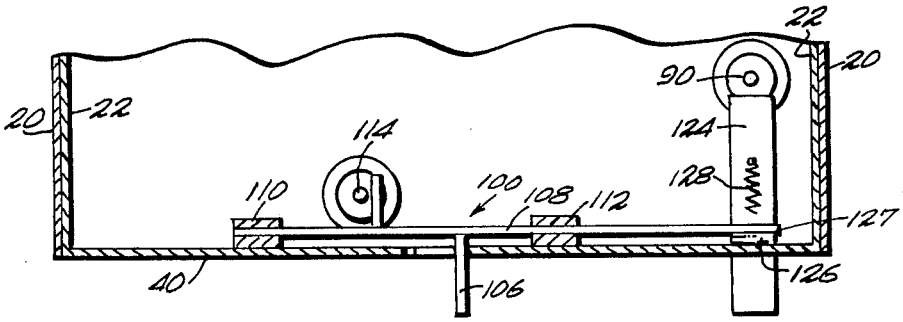
FIG. 7 is a fragmentary, longitudinal cross-sectional view taken along the line 7—7 of FIG. 1.
Figure 8:
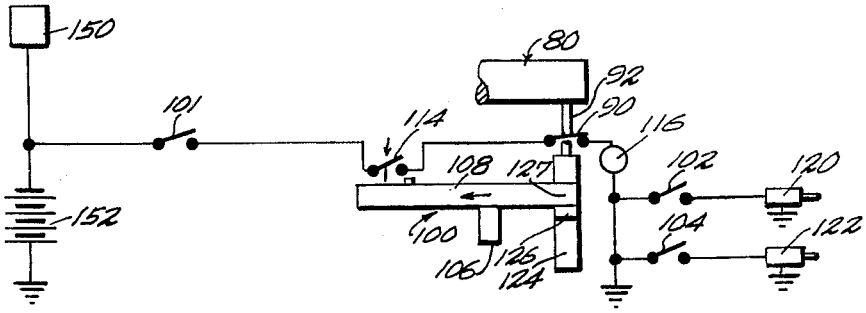
FIG. 8 is a schematic diagram of the control circuitry for the device.

As best illustrated in FIG. 7, a safety guard means 100 may be provided to prevent accidental operation of the ignition, hood or trunk switches 101, 102, and 104, FIGS. 1 and 8 after the combination is made. With the combination made, the lever arm 106, fixed to a longitudinal bar 108, interiorally of the front wall 40, is moved to the left in guide means 110 and 112 to trip a toggle switch 114 to an "on" position to illuminate a pilot light 116 on the front panel 40. Simultaneously, as seen in the schematic wiring diagram of FIG. 8, circuits will be completed to switches 101, 102 and 104 to permit selective operation of the ignition switch 101 or the hood or trunk lid opening switches 102 or 104 which actuate solenoid latch means 120 and 122.

An inwardly movable slide bar 124 aligned with the main toggle switch 90 is normally restrained against inward movement by an abutment 126, fixed thereto, by one end 127 of the safety guard means 100. When the guard means 100 is shifted to the left as seen in FIGS. 7 and 8, the slide bar 124 is freed from the abutment 126 to permit inward movement of slide bar 124 to trip the main toggle switch 90 to an "off" position for safety purposes. The combination must then be remade before the ignition, hood or trunk switches 101, 102 or 104 can be energized. The slide bar 124 is normally urged outwardly by a tension spring 128.

The third housing member 19 which provides for access to the interior chamber 129 of the housing assembly through the top and rear ends may be removed only when the top and rear ends may be removed and only when the combination is made. To this end a key member 130, FIG. 2, is fixed as by welding to the inner side of one end wall 20 of the third housing member 19. A pin 132 projects longitudinally inwardly from the key member 130 and is normally positioned beneath the rear end of an interior transverse pin 134.

Figure 6:
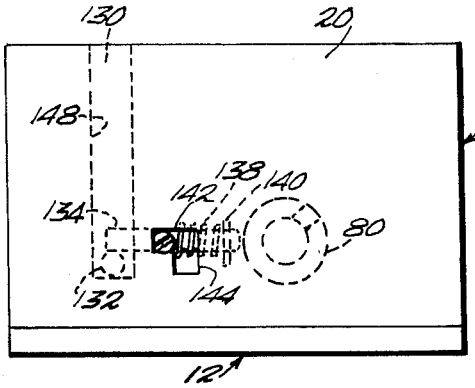
FIG. 6 is an elevational view of the left end of the device as seen in FIG. 1.

As best seen in FIGS. 2, 3 and 6, a screw means 136 extends through the transverse pin 134, forwardly of the pin 132, and a compression spring 138 is disposed about said transverse pin 134 between said screw 136 and an ear 140 projecting inwardly from the side wall 22. A right angular slot 142 is provided through the side walls 20 and 22 in registration with the screw 136 whereby an appropriate tool may be utilized to engage the screw head to move the transverse pin 134 forwardly to build up compression forces in spring 138 to provide a pressure contact between the forward end of pin 134 and the control shaft 80. Movement of the head of screw 136 downwardly into the forward vertical portion 144 of the right angular slot 142 locks the forward end of pin 134 in said pressure contact. When the combination is made as above described, the forward end of the transverse pin 134 penetrates into a hole 146 in the control shaft 80 a distance sufficient to free the rear end of the transverse pin 134 from the longitudinal pin 132. The third housing member may then be upwardly removed, the key member 130 sliding through a mating slot 148 in the side wall 22 of the second housing member 14.

An emergency outlet plug 150 may be provided for connection to an outside battery in the event of failure of the car battery 152. In the above described manner the combination lock of the present invention will permit the driver to operate this car as usual with the ignition key, provided the proper combination is made, and have protection against accidental opening of the hood or trunk lid. As seen in FIG. 2, a wiring inlet 154 54 communicates through the base member 12 to the interior chamber 129.

While I have illustrated and described herein only one form in which my invention can conveniently be embodied in practice, it is to be understood that this form is presented by way of example only and not in a limiting sense. The invention, in brief, comprises all the embodiments. and modifications coming within the scope and spirit of the following claims.

What I claim as new and desire to secure by Letters Patent is:

1. A combination lock for an automotive vehicle ignition, hood and trunk lid comprising an ignition switch and hood and trunk lid switches, a main housing including a removable portion for access to an interior chamber, defined by said housing; a longitudinally extending control shaft, rotatably journaled in said chamber between opposed end walls of said housing; a plurality of lug means, fixed relative to said control shaft, providing abutment surfaces, spaced circumferentially outwardly of the outer surface of said control shaft in a predetermined, equally spaced apart relationship; a plurality of outwardly accessible push buttons, exceeding in number the number of said lug means; a plurality of inwardly extending arms connected to respective push buttons, corresponding in number to the number of lug means, and in respective alignment therewith, each of said arms including an inner abutment surface positioned to contact one of said lug abutment surfaces to rotate said control shaft through a predetermined number of degrees when the arm carrying push buttons are depressed in a proper sequential order; a lock bar, longitudinally slidable in said interior chamber in a parallel relationship with said control shaft and including tension spring means to normally maintain said lock bar in a first position; lock means associated with said lock bar and arms to first, move said lock bar to a second position as each arm carrying push button is sequentially actuated in proper order, and, second, to permit the lock bar to return to said first position to sequentially lock said arms and push buttons in their depressed positions; a first electric switch, located adjacent to one end of said control shaft; positioned to trip said first switch when all of said arm carrying push buttons have been depressed in a proper sequential order, to initially condition electric circuits to said ignition switch and to a pair of switches in respective circuits to hood and trunk lid solenoid actuated latches.

2. The lock as defined in claim 1 including a safety guard, longitudinally slidable within said interior chamber by a lever arm, projecting outwardly through a slot in the front wall of said housing, said safety guard being movable from a first, neutral position to a second position to trip a second switch to an "on" position to illuminate a pilot light and to finally condition the circuits to said ignition switch and to said pair of switches to the hood and trunk lid solenoids.

3. The lock as defined in claim 2 including an inwardly movable slide bar, in transverse alignment with said first electric switch means, said slide bar including abutment means normally engaging said safety guard in said first position to prevent said inward movement, and being free for said inward movement, after said safety guard is moved to said second position, to trip said first switch means to an "off" position.

4. The lock as defined in claim 1 wherein said main housing comprises a first base portion, fixed as by a first screw means to a top portion of the instrument panel of an automotive vehicle, and providing centrally disposed, transverse groove means for slidable receiption of mating tongue means carried by a bottom wall of a second portion of said main housing, said second portion being fixed by second screw means to said first base portion when said tongue means is engaged in said groove means, said second housing portion includes said bottom wall, a pair of opposed end walls and a front wall.

5. The lock as defined in claim 4 wherein said main housing includes a third housing portion comprised of top, back and opposed side wall overlying said second housing side walls.

6. The lock as defined in claim 5 including latch means maintaining said third housing portion in place relative to said second housing portion and providing release means to disengage said latch means therefrom only when the actuation of the proper combination of said push buttons has been completed.

7. The lock as defined in claim 6 wherein said latch means comprises a key means, fixed to said "third" housing member, vertically, slidably engaged in a vertical slot in said second housing member, a longitudinally, inwardly extending pin from said key means, a transverse pin normally having a first end engaging over said longitudinally extending pin in a first position to prevent upward movement of said third housing portion relative to said second housing portion, compression spring means, circumposed about said transverse pin, means to urge a second end of said transverse pin against said control shaft under compression forces of said compression spring means; a generally radially extending hole in said control shaft positioned to slidably receive said transverse pin second end when the proper combination has been made to disengage said first end from said longitudinally extending pin to permit upwardly sliding removal of said third housing portion from said second housing portion.

8. The lock as defined in claim 7 including externally operable means fixed to said transverse pin movable from a first position to a second position to provide the compression forces to said compression spring.

9. The lock as defined in claim 1 including a radially extending arm from said control shaft, positioned to engage a cam notch in said lock bar at the completion of the proper combination to move said latch bar to said second position to release the push buttons for return to their outwardly extended positions.

10. The lock as defined in claim 9 including a helical torsion spring, fixed relative to said control shaft and one of said housing side walls to return said control shaft to its normal position when said combination is made thereby disengaging said radially extending arm from said cam notch and permitting said lock bar to return to its first position.

11. The lock as defined in claim 1 including a receptacle and suitable electric leads fixed in said housing for plug in reception of an outside battery to energize the device in event of failure of the vehicle battery.

12. The lock as defined in claim 1 including tension spring means to return each of said push buttons to its normally outwardly extended position after having been depressed.

* * * * *